US005457303A

United States Patent [19]

Shute et al.

[11] Patent Number: 5,457,303

[45] Date of Patent: Oct. 10, 1995

[54] MICROWAVE OVENS HAVING CONDUCTIVE CONVEYOR BAND AND APPLICATOR LAUNCH SECTION TO PROVIDE PARALLEL PLATE ELECTRIC FIELD

[75] Inventors: Martin R. Shute, Harpenden; Peter N. Daines, Crowland; Roger J. Meredith, Oakham, all of England

[73] Assignee: APV Corporation Limited, London

[21] Appl. No.: 109,350

[22] Filed: Aug. 20, 1993

[30] Foreign Application Priority Data

May 5, 1993 [GB] United Kingdom ..... 9309202

[51] Int. Cl.[6] ..... H05B 6/78; H05B 6/72

[52] U.S. Cl. ..... 219/700; 219/695; 219/750

[58] Field of Search ..... 219/700, 701, 219/695, 696, 697, 746, 750, 748

[56] References Cited

U.S. PATENT DOCUMENTS

| | | | |
|---|---|---|---|
| 3,457,385 | 7/1969 | Cumming | 219/695 |
| 3,474,209 | 10/1969 | Parker | 219/695 |
| 3,622,732 | 11/1971 | Williams | 219/695 |
| 3,764,768 | 10/1973 | Sayer, Jr. | 219/748 |
| 4,570,045 | 2/1986 | Jeppson | 219/699 |
| 4,861,955 | 8/1989 | Shen | 219/699 |
| 4,889,965 | 12/1989 | Gervais et al. | 219/696 |
| 4,956,530 | 9/1990 | Koch | 219/701 |
| 4,962,298 | 10/1990 | Ferrari et al. | 219/701 |

*Primary Examiner*—Philip H. Leung
*Attorney, Agent, or Firm*—Quarles & Brady

[57] ABSTRACT

There is disclosed a microwave applicator which is positioned above an electrically conductive conveyor band on which products, such as biscuits in a baking oven, are carried to be subjected to microwave radiation, the applicator having a launch section configured to provide an electric field in the region above the band which is that which would exist in a parallel plate transmission line extending lengthwise of the oven, the electric field having a plane of polarity which is normal to the plane of the band.

14 Claims, 3 Drawing Sheets

MICROWAVE OVENS HAVING CONDUCTIVE CONVEYOR BAND AND APPLICATOR LAUNCH SECTION TO PROVIDE PARALLEL PLATE ELECTRIC FIELD

BACKGROUND OF THE INVENTION

This invention relates to microwave ovens particularly, but not exclusively, to industrial ovens for food products such as biscuits, snacks, chips, meat substitutes. The invention may however be applied to non-food products, such as to the heating of plastics.

Continuous ovens for food products such as biscuits can be designed to have a plurality of zones through which each food product travels in sequence. Such zones can be used to provide different heating and baking conditions. Multi-media ovens combine different means of heating a food product in the different zones, such as cyclotherm radiant heating, gas or electrically heated convection, near infrared radiant heat, and are well-known in the industry.

In addition to the usual methods of heating we have shown it to be advantageous to inject microwave energy into an oven at various positions along the oven length. Such an oven which employs microwave heating in addition to another form of heating is hereinafter referred to as a 'combined oven'.

Microwave heating provides means to induce a rapid transfer of energy to the product, the level of energy transfer being selected to provide a desired effect within the product. In a proposed combined microwave-biscuit oven, using four microwave zones, the first microwave zone induces a rapid rise in temperature within the product, the second microwave zone enhances development, and the third and fourth microwave zones reduce the moisture content of the product prior to leaving the oven.

Conventionally heated industrial ovens for food products generally use a metal band to support and convey the food products through the oven. The band may be a metal strip or a mesh band.

The use of a metal band in a multi-mode microwave oven, however, gives rise to serious problems. The microwave heating efficiency is found to be reduced to unacceptably low levels, especially with thin food products such as biscuits.

Industrial microwave units basically consist of a microwave generator and a microwave applicator.

We have appreciated that one of the reasons for the low efficiency of prior art combined ovens is that the conventional applicators operate in a plurality of modes, and that the use of substantially a single mode can provide advantages.

The terms 'band-parallel' and 'band-normal' used herein are intended to refer to directions which are parallel to and normal to, respectively, the plane of the oven band. Whilst the oven band will often be horizontal, it should be appreciated that the oven band need not always be horizontal since products can be conveyed on a sloping band.

SUMMARY OF THE INVENTION

According to one aspect of the invention a microwave tunnel oven comprises a microwave applicator extending transversely of an electrically conductive oven band and so arranged as to produce electric fields in the region above the band with a plane of polarisation substantially perpendicular to said conductive oven band, and propagated in a direction substantially lengthwise of the band.

The band-parallel component ($E_h$) of the electric field will be constrained by the conductive band to be zero at the band, and will be small in the region closely adjacent to the band. The vertical component ($E_v$) of the electric field is arranged to be sufficient to provide heating of the product carried on the conductive band.

The applicator is essentially configured to create, in the absence of a product, radiation propagated lengthwise of the band in the (TEM) transverse electromagnetic mode. The presence of a product will distort the radiation pattern.

Designs in accordance with the invention aimed at producing such an E-field take account of the conductive oven band in the overall design of the microwave applicator. If the head-space between the product and the applicator is small (such as 40 mm), the equivalent of a parallel-plate transmission line can be created.

In experiments in which microwaves are simply fed from the sides of the parallel-plate transmission line so formed, and in the presence of the product, there was found to be a high attenuation of the microwave energy propagating between the plates normal to the axis of travel of the band. This caused severe non-uniformity of heating of the product on oven bands of width greater than 100 mm.

We have designed applicator configurations which launch a quasi-plane wave longitudinally of the oven band, and thereby provide, in conjunction with the band, the equivalent of a parallel plate waveguide extending longitudinally of the oven.

Such an applicator configuration can provide improved heating uniformity across the oven width.

This requires a single-mode microwave applicator with substantially constant amplitude illumination in its aperture plane.

Means for broadcasting such a waveform will be described hereinafter, and relate to a microwave generator frequency of 2450 MHz. Other (lower) frequencies can be used but, due to the resultant longer wavelength, less uniform illumination will be achieved.

The microwave applicator preferably comprises an elongate feeder waveguide extending substantially transversely of the band and positioned above the band, the waveguide being provided with a plurality of longitudinally spaced-apart radiation emitter means adapted to emit radiation with a substantially vertically polarised electrical component.

A phased array of said emitter means is preferably employed to broadcast the waveform, that is there is a uniform phase difference between adjacent pairs of emitter means of the plurality of emitter means.

The feeder waveguide is preferably a rectangular section waveguide.

The emitter means may be slots in one wall of the waveguide or antenna associated with respective probes which extend inwardly of the waveguide from a wall of the waveguide.

The emitter means are preferably spaced-apart along the waveguide on a pitch of substantially half a guide wavelength.

When the emitter means are antennas the antennas may be carried on the underside of the waveguide. Alternatively the antennas could be connected to respective probes located in the waveguide by respective waveguide links, such as coaxial waveguide links.

When the emitter means are slots, each slot is preferably of a length substantially half a free-space wavelength.

Such slots are preferably provided in a broad side of the waveguide which is oriented substantially normal to the band.

The applicator preferably comprises a launch section positioned above the band and alongside the plurality of emitter means, the launch section being configured to maintain the polarisation of the radiation emitted by the emitter means.

When the emitter means are slots in the broadside of the feeder waveguide, the launch section of the applicator preferably comprises, as viewed in longitudinal section of the oven, a first stage positioned adjacent to said feeder waveguide and in the near field of the slots, and a second stage remote from said feeder waveguide and in the far field of the slots. The first stage preferably comprises upper and lower first stage plates disposed above and below respectively said slots, said upper first stage plate extending longitudinally outwardly from said feeder waveguide to connect with said second stage, said second stage comprising a panel extending downwardly and away from said upper first stage plate, and said lower first stage plate extending away from said feeder waveguide.

Preferably said upper and lower first stage plates, as viewed in longitudinal section of the oven, are essentially mirror images of each other about a longitudinal plane that extends symmetrically through said plurality of slots, in order to maintain symmetry of the waveform in the near field of the slots.

Most preferably said upper and lower first stage plates are substantially flat plates, said upper first stage plate extending upwardly and longitudinally, with respect to the band, from said feeder waveguide, said lower first stage plate extending downwardly and longitudinally, with respect to the band, from said feeder waveguide, so as to define a cavity in the near field of the slots which expands in the direction proceeding away from said slots.

A parallel plate portion of the applicator may be provided, said parallel plate portion extending substantially parallel to the band and away from the launch section of the applicator, with which the parallel plate portion is continuous. Such a parallel plate portion effectively extends the length of the applicator in the longitudinal direction of the band, to retain the polarisation of the waveform when the products to be heated are low loss products which do not readily absorb the waveform and accordingly allow the waveform to travel further along the oven.

According to a second aspect of the invention a microwave tunnel oven comprises an electrically conductive band on which the products are conveyed in use through a plurality of heating zones, microwave heating means for heating one of the zones, the microwave heating means comprising a microwave generator coupled to a microwave applicator positioned above the band adapted to emit microwave radiation into said one zone, the applicator being arranged, in the absence of a product on the band, to produce radiation substantially in the TEM mode in the region between the applicator and the band.

Various embodiments of the invention will now be described, by way of example only, with reference to the accompanying drawings in which:

BRIEF DESCRIPTION OF THE DRAWINGS

With reference to FIG. 1, an oven comprises side-walls S and a roof R. The side walls S are spaced-apart by a distance of typically 1 or 1.2 meters. Food products 1 are conveyed on a horizontal steel oven band 2 extending between side walls S through a vertically polarised E-field shown $E_v$ and $E_h$, broadcast from an array of slots 8 formed on oppositely facing broad sides 3' of a pair of oblong-rectangular cross-section feeder waveguides 3 of a double applicator. Launch sections 5 of the applicator consist of first launch stage 6, adjacent to the respective waveguide 3, and a second launch stage remote from the respective feeder waveguide 3 in the form of a panel 7, curved at a radius $R_1$ to connect the end of the first launch stage smoothly with horizontal plates 11 of the applicator. A respective treatment space 7' is defined between the panel 7 and the band 2.

Figure 1:
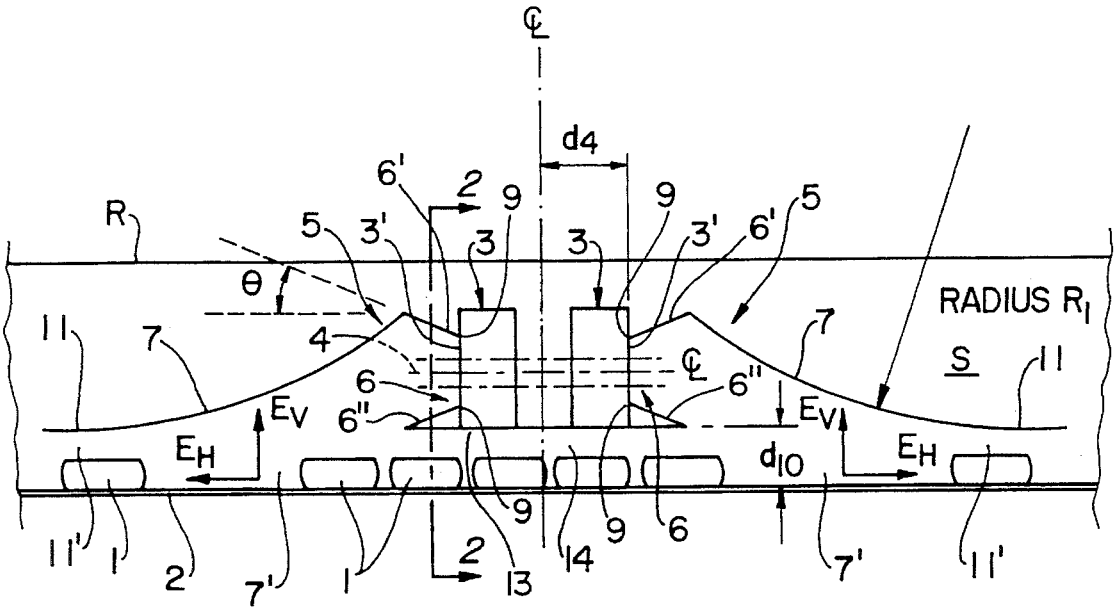
FIG. 1 is a schematic longitudinal vertical cross-section of one of the microwave zones of a first combined microwave-biscuit oven, in accordance with the invention, showing an applicator in transverse cross-section, the applicator comprising transverse waveguides incorporating slots, in combination with associated launch sections.

Thus the first stage 6 of each launch section 5 is defined by an upper first stage plate 6' and a respective lower first stage plate 6". The upper first stage plate 6' in proceeding from the associated waveguide 3 is directed upwardly and longitudinally of the oven, at an angle of θ to the plane of band 2, whereas the respective lower first stage plate 6" lies beneath the upper first stage plate 6' and extends downwardly in proceeding longitudinally of the oven from the waveguide 3, from below the slots 8, at the same angle θ relative to the plane of the band 2.

Thus the upper and lower first stage plate pairs define between them a respective cavity 15, in the near field of the slots 8, which expands in the direction proceeding away from the slots of the respective feeder waveguide 3.

The longer second stage panel 7 extends closer to the band 2 in proceeding longitudinally of the oven from the connection between the second stage panel 7 and the extremity of the respective upper first stage plate 6', to merge with the horizontal plates 11 of the applicator.

Figure 2:
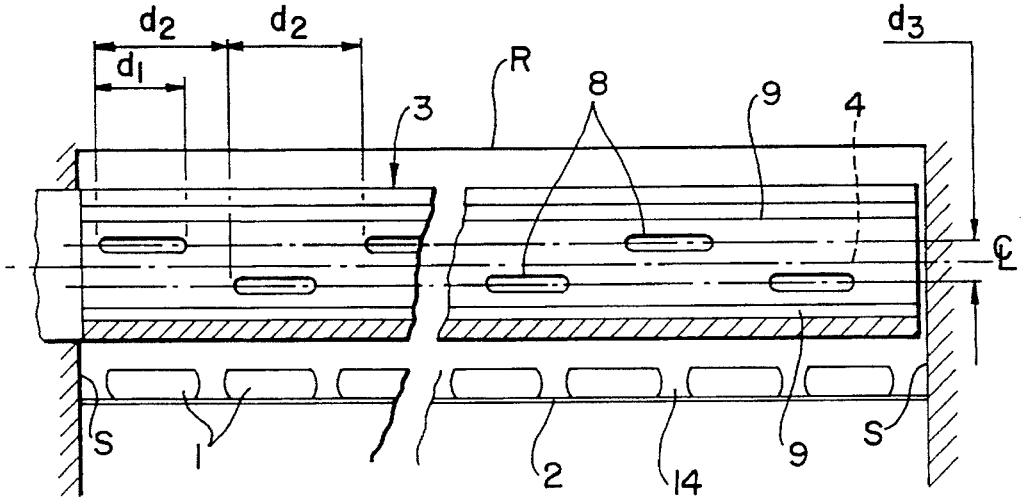
FIG. 2 is a section in the line A—A of FIG. 1 and looking in the direction of travel of the oven band, to show the broad, slotted side of one of the pair of slotted waveguides.

The applicator, as shown in FIG. 2, extends for almost the full width of the oven, and the cross-sectional configuration shown in FIG. 1 is uniform for that full length of the applicator. As shown in FIG. 2 the feeder waveguides extend through one wall S of the oven for connection to a remote microwave generator means.

With reference to FIG. 2, food products 1 are conveyed on oven band 2 under the applicator 3. Slots 8 of length $d_1$ are formed in one broad side 3' of each waveguide 3 pitched evenly by dimension $d_2$ and arranged evenly and alternately about the centre-line 4 of the side 3' at a distance $d_3$. This may require a flare to compensate for a bias of power transmitted from the first to the last slot. (Microwave theory would imply that the spacing about the centre-line of each slot should be different as the effect of neighbouring slots varies from slot to slot, depending upon their relative positions. (These variations are small in practice and can be ignored.) The positions of the edges 9 of the first stage plates 6', 6" of the launch section 5 are arranged so that the centre-line of the slots is equidistant between the edges 9 and the centre-line 4 of the broad face 3' of the respective waveguide.

A base plate 13 extends from the lower edges of lower panels 6", and also defines the lower short side of the feeder waveguides 3, the base plate 13 extending parallel to the band 2 to define between the plate 13 and band 2 a further treatment space 14. Standing waves created in space 14 by reflections from the launch sections 7 provide additional heating of the products 1 as they pass beneath plate 13.

Further treatment spaces 11' are defined between the horizontal plates 11 and band 2. Depending on the nature of the products being heated most of the microwave energy will have been absorbed by the products in the treatments space 7' and little radiation will reach space 11'. However, for some products heating will take place in space In the embodiment of FIG. 1 the upper and lower first stage plates 6' and 6' are set at equal angles θ relative to the plane of the band 2. In modifications, not illustrated, the plates 6' and 6" could be of different shape and orientation but best results are likely to be achieved when the plates 6' and 6" are arranged in mirror image configuration relative to that plane which includes the centre-line of the slots 8 and is parallel to the plane of the band 2.

Figure 3:
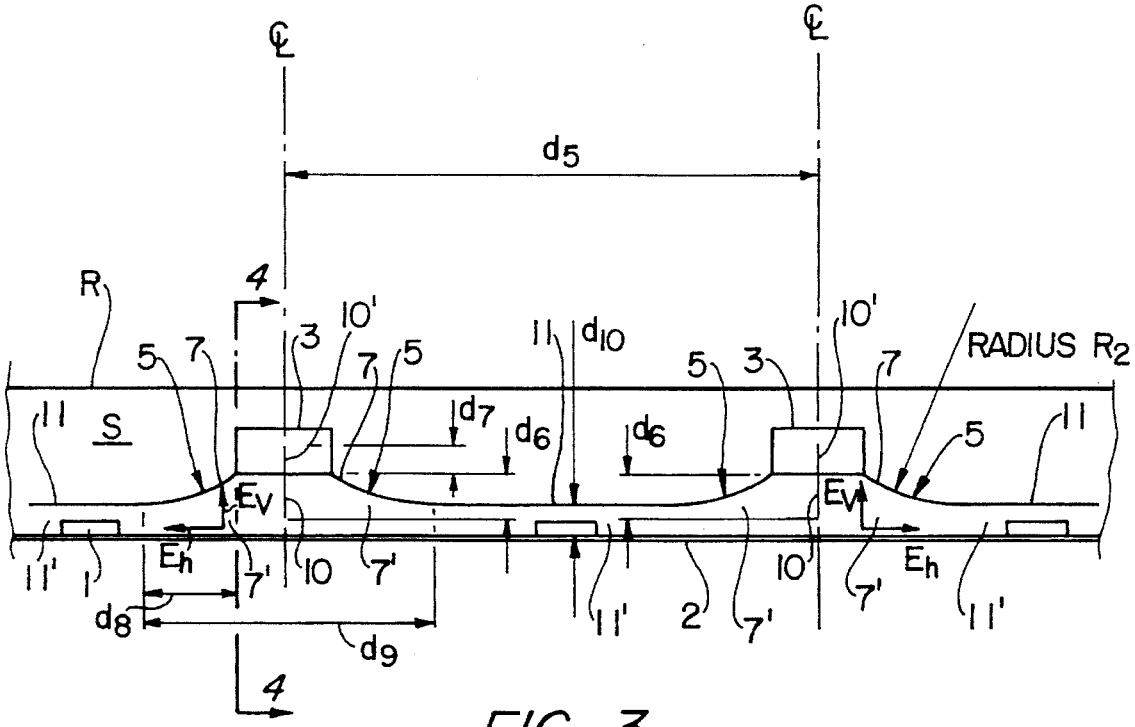
FIG. 3 is a schematic longitudinal vertical cross-section of the microwave zone of a second combined microwave-biscuit oven in accordance with the invention, using transverse waveguides incorporating probe-fed monopole aerials in combination with associated launch sections.
Figure 4:
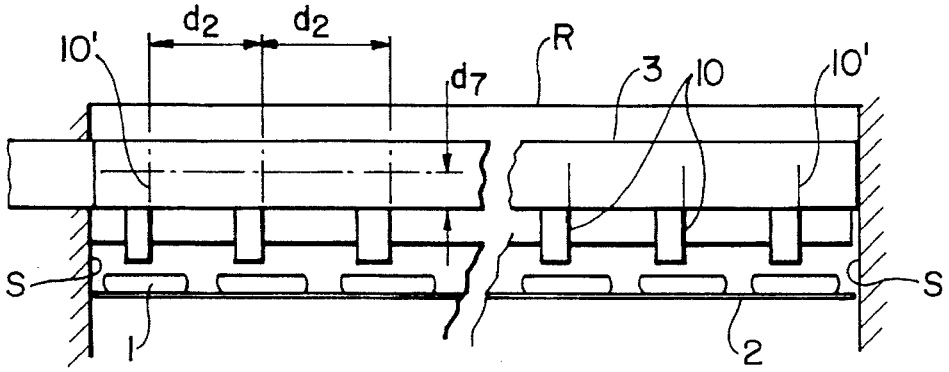
FIG. 4 is a section on the line 4—4 of FIG. 3 and looking in the direction of travel of the oven band, of a waveguide incorporating probe-fed monopole aerials.
Figure 5:
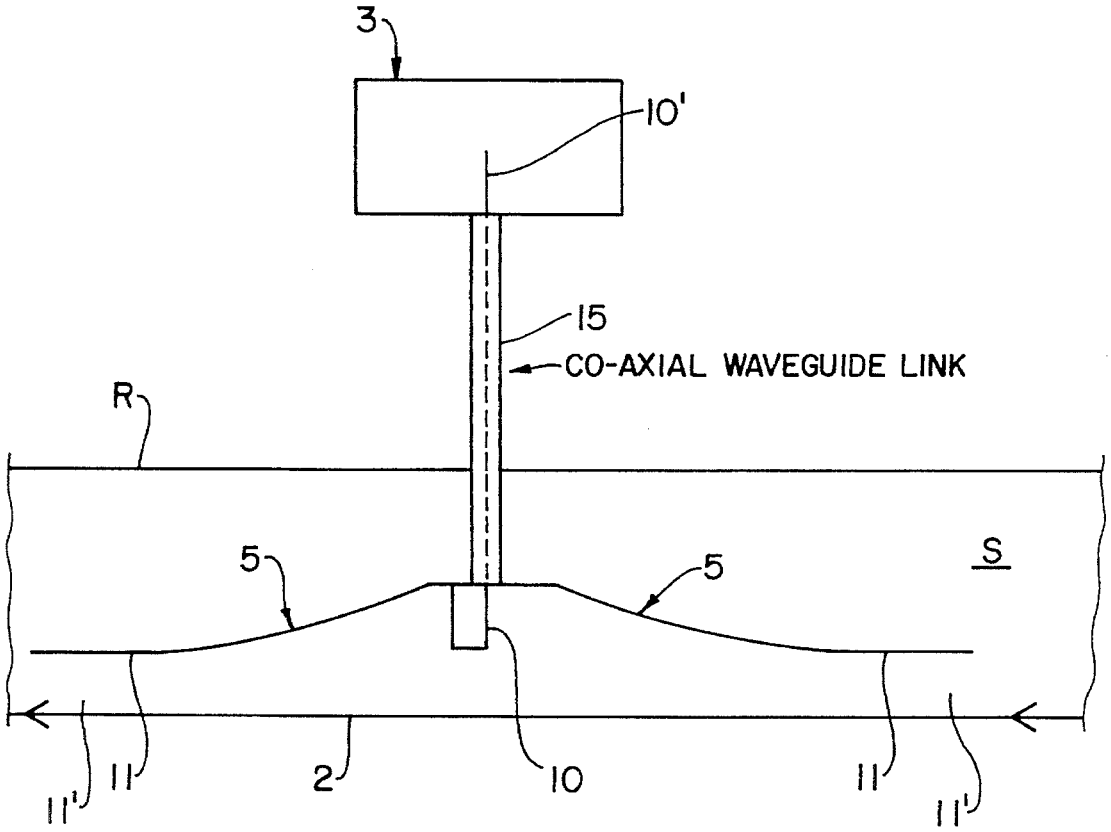
FIG. 5 shows a modification of the oven of FIGS. 3 and 4 in which the waveguide fitted with probes is external to the oven housing.

In FIGS. 3, 4 and 5 parts corresponding to those of FIGS. 1 and 2 have been given corresponding reference numerals.

Referring now to FIGS. 3 and 4, food products 1 are conveyed on a steel oven band 2 beneath an applicator which creates a vertically polarised E-field, shown $E_v$ and $E_h$, broadcast from an array of probe-fed monopole antennas 10 located on the bottom face of two rectangular cross-section spaced-apart feeder waveguides 3. Each antenna 10 is fed by a respective probe 10". The launch sections 5 in this case each consist of a flared panel structure 7 set at a radius $R_2$ to extend between the waveguide 3 and portions 11 of the applicator parallel to the band 2. Dimension $d_7$ is determined by the power requirements.

In the embodiment of FIGS. 1 and 2, the applicator uses a pair of waveguides 3 extending substantially transverse to the direction of travel of the steel band conveyor 2, each of the waveguide feeds being of oblong-rectangular cross-section, as shown in FIG. 1, with the longer dimension of this cross-section disposed vertically and with the slots 8 formed on one of the broad sides 3'. This arrangement is used in combination with the launch section 5 to direct the waveform 'through' the top plate of the equivalent parallel plate waveguide. The length of the slots 8 is substantially one half the free-space wavelength for the chosen frequency and the slots 8 are spaced apart by one half guide-wavelength. Adjacent slots 8 are arranged alternately on opposite sides of the centre-line 4of the broad face 3' of the waveguide 3 to allow for phase reversal of the waveform in the guide. In this way a substantially uniform microwave illumination can be achieved.

Additionally, by arranging a second similar pattern of slots 8 to be repeated on the outwardly-facing broad face 3' of the second waveguide 3, but out-of-phase, in the transverse direction of the band, to the first set of slots by an amount equal to one quarter guide-wavelength, compensation for any non-uniformity of microwave illumination can be achieved, in that the accumulated exposure of a single product to the waveform will be evened out when the product has passed through the two fields generated by the respective waveguides 3.

The launch section 5 of the applicator of FIGS. 1 and 2 is arranged initially to ensure symmetry in the very near field of the slots 8 and then to provide a guide for the waves 'through' the top plate of the equivalent parallel plate waveguide. The exact dimensions are determined empirically to achieve a substantially uniform microwave illumination across the oven band and to maintain vertical polarisation of the E-field.

In the arrangement of FIGS. 3 and 4, the applicator uses an array of probe-fed monopole antennas distributed across the width of the oven but located on the underside of the transverse feeder waveguide.

This arrangement is used in combination with a launch section 5 arranged to direct the waveform 'through' the top plate of the equivalent parallel plate waveguide. The length of each of the monopoles 10 is preferably substantially one quarter the wavelength of the free-space waveform for the chosen frequency.

Folded monopoles, as shown in FIG. 4, are preferred because they are self-supporting and do not require a ceramic holder.

The power broadcast from each antenna 10 is proportional to the protrusion of the associated probe 10' into the waveguide, this being arranged to suit the power transmission requirements.

The configuration of the launch sections 5 in FIG. 3 is based on similar principles to those used for the slotted waveguide of FIGS. 1, 2 but in this case the provision of plates such as plates 6', 6" used in FIGS. 1, 2 to ensure symmetry in the near field is unnecessary. Thus, the curved plate 7 extends directly from the respective feeder waveguide 3. Additionally, and in a similar manner to the slotted configuration of FIGS. 1, 2, the arrangement of probes 10 is repeated on a second waveguide 3 but so as to be out-of-phase with respect to the antennas on the first waveguide 3, in the transverse direction of the band, by an amount equal to one quarter the guide wavelength; in a like manner this compensates overall for any non-uniformity of microwave illumination.

The exact dimensions of the launch sections 5 are determined empirically to achieve a substantially uniform microwave illumination across the oven band and to maintain vertical polarisation of the E-field, but approximate values can be related to the wavelengths used.

The wavelengths referred to are determined by the choice of frequency and can be expressed as follows:

$$\lambda = C/f$$

where

λ is the free-space wavelength of the waveform f is the chosen frequency in Hertz c is the speed of propagation of the waveform in free-space $E_r$ is the relative dielectric constant and $$\lambda_g = \lambda[E_r - (\lambda/\lambda_c)^2]^{-1/2}$$

where $\lambda_g$ is the guide-wavelength $\lambda_c$ is the factor related to the waveguide, and is typically twice the broad dimension of waveguide With reference to FIGS. 1, 2, 3 and 4, the dimensions noted have typical values defined as follows:

$d_1 = \lambda/2$ $d_2=\lambda_g/2$ $d_3$ is symmetrical about the centre-line of the broad face of the waveguide and is found experimentally by means of power reflection measurements to give equal power drop per slot pair.

$d_4$ should be the minimum possible compatible with the construction of the waveguides.

$d_5=6_\lambda$(minimum)

$d_6=\lambda/4$ $d_7$ is proportional to the power transmission requirement $d_8=1.3\lambda$(approx)

$d_9=3.3\lambda$ $d_{10}=40$ mm (this is selected to be a minimum to clear the product) $R_1$ and $R_2$ are in the range of $4\lambda$ to $5\lambda$ $\theta$ is in the range of 10 to 20 degrees.

FIG. 5 shows that the feeder waveguide 3 fitted with probes 10' may be positioned external to the oven, the probes 10' being connected to respective antennas 10 positioned within the oven by respective coaxial waveguide links 15.

What is claimed is:

1. A microwave tunnel oven for subjecting products conveyed through the oven to microwave radiation comprising a tunnel oven casing, said oven casing comprising spaced apart oven tunnel sidewalls and an oven roof connecting said side-walls, an electrically conductive product-supporting conveyor band positioned between said side-walls and beneath said roof to extend lengthwise of said tunnel, band drive means operative to drive said band, a microwave generator means, a microwave applicator positioned between said side-walls and above said band, microwave supply means connecting said generator means to said applicator, said applicator comprising an elongate microwave emitter assembly extending transversely of the oven band, microwave launch means extending longitudinally of the oven and above the band from adjacent to said emitter assembly, said emitter assembly comprising a plurality of spaced-apart microwave emitter means for emitting radiation into the oven generally in a longitudinal direction of the oven with a plane of polarisation substantially perpendicular to said oven band, at least a portion of said launch means and said band defining therebetween a microwave treatment space through which said products are conveyed in use for being subjected to microwave radiation, said launch means being configured to maintain the polarisation of the radiation in said treatment space substantially perpendicular to said oven band.

2. An oven as claimed in claim 1 wherein said launch means comprises a launch panel which, as viewed in longitudinal vertical cross-section of said oven, extends closer to the band in proceeding away from said emitter assembly.

3. An oven as claimed in claim 2 wherein said launch panel is curved to connect smoothly with a plate which is substantially parallel to said band.

4. An oven as claimed in claim 1 wherein said plurality of microwave emitter means are arranged as a phased array, whereby there is a uniform phase difference between adjacent pairs of emitter means of said plurality of emitter means.

5. An oven as claimed in claim 4 wherein said feeder waveguide is located externally of said oven casing, and said plurality of microwave emitter means is connected with said feeder waveguide by a plurality of coaxial waveguide links, said links extending through said oven casing.

6. An oven as claimed in claim 1 wherein said microwave emitter assembly comprises a feeder waveguide extending transversely of the oven band.

7. An oven as claimed in claim 6 wherein said feeder waveguide is positioned in said oven below said oven roof.

8. An oven as claimed in claims 6 wherein said plurality of microwave emitter means comprises a plurality of slots in said feeder waveguide, said slots facing longitudinally of said oven.

9. An oven as claimed in claim 8 wherein said microwave launch means comprises, as viewed in longitudinal vertical section of the oven, a first stage positioned adjacent to said feeder waveguide, and a second stage remote from said feeder waveguide, said first stage comprising upper and lower first stage plates disposed above and below respectively said slots, and extending generally longitudinally of the oven from said feeder waveguide, said second stage comprising a panel extending closer to said band in proceeding away from said first stage, said upper first stage plate meeting said second stage panel at a junction therebetween.

10. An oven as claimed in claim 9 wherein said upper and lower first stage plates, as viewed in longitudinal vertical section of the oven, are essentially mirror images of each other about a longitudinal plane that extends symmetrically through said plurality of slots and parallel to said band.

11. An oven as claimed in claim 9 wherein said upper and lower first stage plates are flared apart proceeding in the longitudinal direction of the oven away from said feeder waveguide.

12. An oven as claimed in claim 6 wherein said plurality of microwave emitter means comprises a plurality of antennas depending downwardly from said feeder waveguide, and a plurality of probes located in said waveguide, each said probe being directly connected to a respective said antenna.

13. An oven as claimed in claim 1 wherein two said applicators are provided, and respective microwave supply means are provided for supplying energy from said microwave generator means to said applicators.

14. A baking facility for producing baked food products and comprising an oven, including:

a tunnel oven casing, said oven casing comprising spaced apart oven tunnel side-walls and an oven roof connecting said side-walls, an electrically conductive product-supporting conveyor band positioned between said side-walls and beneath said roof to extend lengthwise of said tunnel, band drive means operative to drive said band, a microwave generator means, a microwave applicator positioned between said side-walls and above said band, microwave supply means connecting said generator means to said applicator, said applicator comprising an elongate microwave emitter assembly extending transversely of the oven band, microwave launch means extending longitudinally of the oven and above the band from adjacent to said emitter assembly, said emitter assembly comprising a plurality of spaced-apart microwave emitter means for emitting radiation into the oven generally in a longitudinal direction of the oven with a plane of polarisation substantially perpendicular to said oven band, at least a portion of said launch means and said band defining therebetween a microwave treatment space through which said products are conveyed in use for being subjected to microwave radiation, said launch means being configured to maintain the polarisation of the radiation in said treatment space substantially perpendicular to said oven band; and food product supply means for supply food products to be baked to substantially the full width of said band.

* * * * *